US009670943B2

(12) United States Patent
Gomm et al.

(10) Patent No.: US 9,670,943 B2
(45) Date of Patent: Jun. 6, 2017

(54) METHOD FOR CONTROLLING PRESSURE IN A HYDRAULIC ACTUATOR

(71) Applicant: Parker-Hannifin Corporation, Cleveland, OH (US)

(72) Inventors: Ralf Gomm, Charlotte, NC (US); Dale Vanderlaan, Waxhaw, NC (US)

(73) Assignee: Parker-Hannifin Corporation, Cleveland, OH (US)

( * ) Notice: Subject to any disclaimer, the term of this patent is extended or adjusted under 35 U.S.C. 154(b) by 6 days.

(21) Appl. No.: 14/786,330

(22) PCT Filed: Apr. 22, 2014

(86) PCT No.: PCT/US2014/034987

§ 371 (c)(1),
(2) Date: Oct. 22, 2015

(87) PCT Pub. No.: WO2014/176256

PCT Pub. Date: Oct. 30, 2014

(65) Prior Publication Data

US 2016/0091004 A1 Mar. 31, 2016

Related U.S. Application Data

(60) Provisional application No. 61/814,372, filed on Apr. 22, 2013.

(51) Int. Cl.

| | |
|---|---|
| ***F15B 21/10*** | (2006.01) |
| ***F15B 11/10*** | (2006.01) |
| *F15B 7/00* | (2006.01) |

(52) U.S. Cl.

CPC ..... *F15B 21/10* (2013.01); *F15B 11/10* (2013.01); *F15B 7/006* (2013.01);

(Continued)

(58) Field of Classification Search

CPC F15B 21/10; F15B 11/10; F15B 7/006; F15B 2211/761

(Continued)

(56) References Cited

U.S. PATENT DOCUMENTS 4,955,283 A * 9/1990 Hidaka ..... E02F 9/2203 91/447
5,916,138 A * 6/1999 Hild ..... F15B 21/14 60/327

(Continued)

FOREIGN PATENT DOCUMENTS

CN 101109398 A 1/2008
WO 2006/088399 A1 8/2006

(Continued)

OTHER PUBLICATIONS

Office Action and translation for corresponding Chinese Patent Application No. 2014800357318 dated Sep. 2, 2016.

(Continued)

*Primary Examiner* — Thomas E Lazo
(74) *Attorney, Agent, or Firm* — Renner, Otto, Boisselle & Sklar, LLP

(57) ABSTRACT

In conventional load-sense systems, there is a delay between a hydraulic function being impeded by an external force and further motion of the function. This is typically due to cavitation on the low pressure side of the pump. Electro-hydraulic systems, however, typically respond very quickly because the low pressure side of the pump may be pressurized because the low-pressure side of the actuator may feed directly to the pump rather than going to tank. Thus, an operator cannot as easily rely on feedback for when a function has encountered an external load. This may result in loss of vehicle traction or other drawbacks. Therefore, provided is a system and method for mimicking a load-sense (Continued)

system's responsiveness using an electro-hydrostatic system via an induced passive or active time-delay.

28 Claims, 4 Drawing Sheets

(52) U.S. Cl.
CPC ..... *F15B 2211/20515* (2013.01); *F15B 2211/20561* (2013.01); *F15B 2211/20569* (2013.01); *F15B 2211/27* (2013.01); *F15B 2211/30515* (2013.01); *F15B 2211/613* (2013.01); *F15B 2211/633* (2013.01); *F15B 2211/6313* (2013.01); *F15B 2211/6346* (2013.01); *F15B 2211/6651* (2013.01); *F15B 2211/7053* (2013.01); *F15B 2211/75* (2013.01); *F15B 2211/761* (2013.01); *F15B 2211/785* (2013.01)

(58) Field of Classification Search
USPC ..... 60/473, 476
See application file for complete search history.

(56) References Cited

U.S. PATENT DOCUMENTS

| | | | | |
|---|---|---|---|---|
| 6,233,511 | B1 | 5/2001 | Berger et al. | |
| 6,912,849 | B2 | 7/2005 | Inoue et al. | |
| 7,069,673 | B2 | 7/2006 | Kagoshima et al. | |
| 7,827,787 | B2 * | 11/2010 | Cherney | E02F 9/2203 60/414 |
| 8,037,807 | B2 | 10/2011 | Callaghan et al. | |
| 9,234,532 | B2 * | 1/2016 | Vanderlaan | F15B 7/006 |
| 2008/0292474 | A1 | 11/2008 | Vigholm et al. | |
| 2008/0294316 | A1 | 11/2008 | Vigholm et al. | |
| 2008/0295504 | A1 | 12/2008 | Vigholm et al. | |
| 2008/0295505 | A1 | 12/2008 | Vigholm et al. | |
| 2008/0302099 | A1 | 12/2008 | Vigholm et al. | |
| 2009/0287373 | A1 | 11/2009 | Vigholm et al. | |
| 2011/0030364 | A1 | 2/2011 | Vanderlaan et al. | |
| 2011/0208363 | A1 | 8/2011 | Gomm et al. | |
| 2011/0209471 | A1 | 9/2011 | Gomm et al. | |
| 2011/0308242 | A1 | 12/2011 | Pfaff et al. | |
| 2012/0216519 | A1 | 8/2012 | Peterson et al. | |
| 2013/0081384 | A1 | 4/2013 | Opdenbosch | |

FOREIGN PATENT DOCUMENTS

| | | | |
|---|---|---|---|
| WO | 2010/028100 | A1 | 3/2010 |
| WO | 2010/151220 | A1 | 12/2010 |

OTHER PUBLICATIONS

International Search Report for corresponding patent application No. PCT/US2014/034987 dated Aug. 26, 2014.
Written Opinion for corresponding patent application No. PCT/US2014/034987 dated May 8, 2015.
International Preliminary Report on Patentability for corresponding patent application No. PCT/US2014/034987 dated Aug. 7, 2015.

* cited by examiner

METHOD FOR CONTROLLING PRESSURE IN A HYDRAULIC ACTUATOR

RELATED APPLICATIONS

This application claims the benefit of U.S. Provisional Application No. 61/814,372 filed Apr. 22, 2013, which is hereby incorporated herein by reference.

This application is a national phase of International Application No. PCT/US2014/034987 filed Apr. 22, 2014 and published in the English language.

FIELD OF INVENTION

The present invention relates generally to electro-hydrostatic actuator systems for powering a consumer such as an asymmetric hydraulic cylinder in a work machine, and more particularly to control algorithm and method capable of automatically controlling pressure in the consumer under certain operating conditions.

BACKGROUND

It is common for a work machine such as but not limited to hydraulic excavators, wheel loaders, loading shovels, backhoe shovels, mining equipment, industrial machinery and the like, to have one or more actuated components such as lifting and/or tilting arms, booms, buckets, steering and turning functions, traveling means, etc. Commonly, in such machines, a prime mover drives a hydraulic pump for providing fluid to the actuators. Open-center or closed-center valves control the flow of fluid to the actuators.

Some modern machines have replaced the traditional hydraulic system described above with an electro-hydrostatic actuator system (EHA). An electro-hydrostatic actuator includes a reversible, variable speed electric motor that is connected to a hydraulic pump, generally fixed displacement, for providing fluid to an actuator for controlling motion of the actuator. The speed and direction of the electric motor controls the flow of fluid to the actuator. Power for the electric motor is received from a power unit, for example a generator, a power storage unit, such as a battery, or both. At, for example, deceleration and/or lowering motion of a load, the power unit may receive power from the said electric motor that is then operated as a generator. A system that includes an electro-hydrostatic actuator is referred to herein as an electro-hydrostatic actuator system.

SUMMARY OF INVENTION

Electro-hydrostatic systems behave differently than conventional load-sense hydraulic systems. In conventional load-sense systems, there is a delay between a hydraulic function (such as an arm or boom) being impeded by an external force (such as the bucket on the arm hitting the ground) and further motion of the function (such as the vehicle lifting off its supports or wheels/tracks). This is typically due to cavitation on the low pressure side of the pump. Electro-hydraulic systems, however, typically respond very quickly because the low pressure side of the pump may be pressurized because the low-pressure side of the actuator may feed directly to the pump rather than going to tank. Thus, an operator cannot as easily rely on feedback for when a function has encountered an external load (hit the ground). This may result in loss of vehicle traction or other drawbacks.

Therefore, provided is a system and method for mimicking a load-sense system's responsiveness using an electro-hydrostatic system via an induced passive or active time-delay.

According to one aspect of the invention, a hydraulic system includes a controller connected to an operator interface; a pump operable in a first direction for supplying pressurized fluid; and a hydraulic circuit having a first side fluidly connecting a first side of the pump to a first port for connection to a consumer, and a second side fluidly connecting the second side of the pump to a second port for connection to the consumer. The controller is configured to receive a user input for controlling the consumer and to supply hydraulic fluid in accordance therewith, to watch for a parameter indicative of pressure in the first side of the hydraulic circuit exceeding a prescribed amount, and in response to the pressure exceeding the prescribed amount to restrict pressure in the first side of the hydraulic circuit until the prescribed amount is increased, thereby delaying consumer motion unless a command to stop consumer motion is given and mimicking responsiveness in a conventional load-sense system.

Optionally, the hydraulic system includes valving fluidly connected between the pump and the ports, the valving controlled by the controller and operative to regulate the pressurized fluid between the pump and the consumer.

Optionally, the user command is a command for lowering an actuator.

Optionally, the consumer is a hydraulic cylinder and the first side of the hydraulic circuit is fluidly connected to a rod-side of the hydraulic cylinder.

Optionally, the controller is further configured to delay increasing a maximum pressure limit after determining to increase the maximum pressure limit based on the evaluation.

Optionally, the parameter is pump speed.

Optionally, the parameter is a movement state of the consumer.

Optionally, the hydraulic system includes an electric machine controlled by the controller and driving the pump, wherein the parameter is electric machine torque.

Optionally, the parameter is pressure in the first side of the hydraulic circuit.

Optionally, the hydraulic system includes an electric machine controlled by the controller and driving the pump, and wherein the controller is further configured to set a maximum pressure limit by setting a torque limit of the electric machine.

Optionally, the pump is a bi-directional pump operable in a first direction for supplying pressurized fluid through the first valve to the consumer for operating the consumer in one direction, and operable in a second direction opposite the first direction for supplying pressurized fluid through a second valve to the consumer for operating the consumer in a direction opposite the first direction.

Optionally, the hydraulic system includes a hydraulic actuator to and from which hydraulic fluid is supplied and returned in opposite directions to operate the actuator in opposite directions.

Optionally, the hydraulic system includes a boost system for accepting fluid from or supplying fluid to the hydraulic circuit of the hydraulic system. The boost system includes a boost pump for supplying fluid to a fluid make-up/return line that selectively is in fluid communication with the consumer, and a boost electric machine for driving the boost pump, the electric machine connected to a boost electric power source through a boost inverter.

Optionally, the hydraulic system includes an electric machine operated by the controller and connected to an electrical source through an inverter to drive the pump.

Optionally, the valving includes a load-holding valve connected between the pump and the first port, the load-holding valve controlled by the controller and operative in a first position to allow flow to the consumer to operate the consumer against a load and operative in a second position to block load-induced return flow from the consumer to the pump.

According to another aspect of the invention, a hydraulic system includes a controller connected to an operator interface; a pump operable in a first direction for supplying pressurized fluid; and a hydraulic circuit having a first side fluidly connecting a first side of the pump to a first port to which a consumer can be connected, and a second side fluidly connecting the second side of the pump to a second port to which the consumer can be connected. The controller is configured to receive a user command for controlling the consumer, to set a maximum pressure limit of the first side of the hydraulic circuit to a first value in response to the user command, to control the pump and valving to implement the user command, to monitor a first system condition, to evaluate the monitored system condition with a prescribed criteria in response to the user command, and to determine whether or not to increase the maximum pressure limit based on the evaluation.

Optionally, the hydraulic system includes valving fluidly connected between the pump and the ports, the valving controlled by the controller and operative to regulate the pressurized fluid between the pump and the consumer.

Optionally, the consumer command is a command for lowering an actuator

Optionally, the consumer is a hydraulic cylinder and the first side of the hydraulic circuit is fluidly connected to a rod-side of the hydraulic cylinder.

Optionally, the controller is further configured to delay increasing the maximum pressure limit after determining to increase the maximum pressure limit based on the evaluation.

Optionally, the first system condition is pump speed.

Optionally, the first system condition is a movement state of the consumer.

Optionally, the hydraulic system includes an electric machine controlled by the controller and driving the pump, wherein the first system condition is electric machine torque.

Optionally, the first system condition is pressure in the first side of the hydraulic circuit.

Optionally, the hydraulic system includes an electric machine controlled by the controller and driving the pump, wherein setting the maximum pressure limit includes setting a torque limit of the electric machine.

Optionally, the pump is a bi-directional pump operable in a first direction for supplying pressurized fluid through the first valve to the hydraulic actuator for operating the actuator in one direction, and operable in a second direction opposite the first direction for supplying pressurized fluid through a second valve to the hydraulic actuator for operating the actuator in a direction opposite the first direction.

Optionally, the hydraulic system includes a hydraulic actuator to and from which hydraulic fluid is supplied and returned in opposite directions to operate the actuator in opposite directions.

Optionally, the hydraulic system includes a boost system for accepting fluid from or supplying fluid to a hydraulic circuit of the hydraulic system. The boost system includes a boost pump for supplying fluid to a fluid make-up/return line that selectively is in fluid communication with the hydraulic actuator, and a boost electric machine for driving the boost pump, the electric machine connected to a boost electric power source through a boost inverter.

Optionally, the hydraulic system includes an electric machine operated by the controller and connected to an electrical source through an inverter to drive the pump.

Optionally, the valving includes a load-holding valve connected between the pump and the first port, the load-holding valve controlled by the controller and operative in a first position to allow flow to the actuator to operate the actuator against a load and operative in a second position to block load-induced return flow from the actuator to the pump According to another aspect of the invention, a method of preventing over-actuation in an electro-hydraulic system includes receiving a requested consumer command; setting a maximum pressure limit of a first side of a hydraulic circuit fluidly connected to the consumer to a first value in response to the requested consumer command; controlling a pump and valving in the hydraulic circuit to achieve the requested consumer command; monitoring a first system condition; evaluating the monitored system condition with a prescribed criteria in response to the requested consumer command; and determining whether or not to increase the maximum pressure limit based on the evaluation.

Optionally, the consumer command is a command for lowering an actuator

Optionally, the consumer is a hydraulic cylinder and the first side of the hydraulic circuit is fluidly connected to a rod-side of the hydraulic cylinder.

Optionally, the controller is further configured to delay increasing the maximum pressure limit after determining to increase the maximum pressure limit based on the evaluation.

Optionally, the first system condition is pump speed.

Optionally, the first system condition is a movement state of the consumer.

Optionally, the method includes controlling and driving the pump via an electric machine, wherein the first system condition is electric machine torque.

Optionally, the first system condition is pressure in the first side of the hydraulic circuit.

Optionally, the method includes controlling and driving the pump via an electric machine, wherein setting the maximum pressure limit includes setting a torque limit of the electric machine.

Optionally, the pump is a bi-directional pump operable in a first direction for supplying pressurized fluid through the first valve to the hydraulic actuator for operating the actuator in one direction, and operable in a second direction opposite the first direction for supplying pressurized fluid through a second valve to the hydraulic actuator for operating the actuator in a direction opposite the first direction.

Optionally, the consumer is a hydraulic actuator to and from which hydraulic fluid is supplied and returned in opposite directions to operate the actuator in opposite directions.

Optionally, the method includes accepting fluid from or supplying fluid to a hydraulic circuit of the hydraulic system via a boost system, wherein the boost system includes a boost pump for supplying fluid to a fluid make-up/return line that selectively is in fluid communication with the hydraulic actuator, and a boost electric machine for driving the boost pump, the electric machine connected to a boost electric power source through a boost inverter.

Optionally, the valving includes a load-holding valve connected between the pump and the first port, the load-holding valve controlled by the controller and operative in a first position to allow flow to the actuator to operate the actuator against a load and operative in a second position to block load-induced return flow from the actuator to the pump Optionally, the method includes operating the pump in one direction for supplying pressurized fluid through the valve to the hydraulic actuator for operating the actuator in a first direction, and operating the pump in a second direction opposite the first direction for supplying pressurized fluid through a second valve to the hydraulic actuator for operating the actuator in a direction opposite the first direction.

Optionally, the method includes driving the pump via an electric machine connected to an electrical source through an inverter.

The foregoing and other features of the invention are hereinafter described in greater detail with reference to the accompanying drawings.

DETAILED DESCRIPTION

Exemplary embodiments of the invention relate generally to hydraulic actuation systems for controlling a hydraulic consumer such as, for example, extending and retracting at least one asymmetric hydraulic cylinder in a work machine, such as but not limited to hydraulic excavators, wheel loaders, loading shovels, backhoe shovels, mining equipment, industrial machinery and the like, having one or more actuated components such as lifting and/or tilting arms, booms, buckets, steering and turning functions, traveling means, etc.

The method is primarily suitable to control the movement of an actuator and associated machine function when such function collides with an external obstacle such as the ground surface. The system has particular application in electro-hydrostatic actuation systems that typically include bi-directional electric motor driven pumps and asymmetric hydraulic actuators connected within closed circuits to provide work output against external loads and reversely recover energy from externally applied loads.

It should be noted that, although described herein in connection with a lowering motion, exemplary systems and methods may be utilized in situations involving any hydraulic function in which an additional resistance is encountered during movement, and the invention should not be considered limited to lowering functions. For example, it may be desirable to include a momentary delay during a swing function when an excavator is swinging into a structure before the excavator engages with enough force to damage the structure. As another example, it may be advantageous for a lift arm to draw a cable or strapping taught without immediately lifting the object to which the cable or strapping is attached. In any case, exemplary embodiments may be employed in extension and/or retraction (in the case of hydraulic cylinders), and with or without external loads applied.

Figure 1:
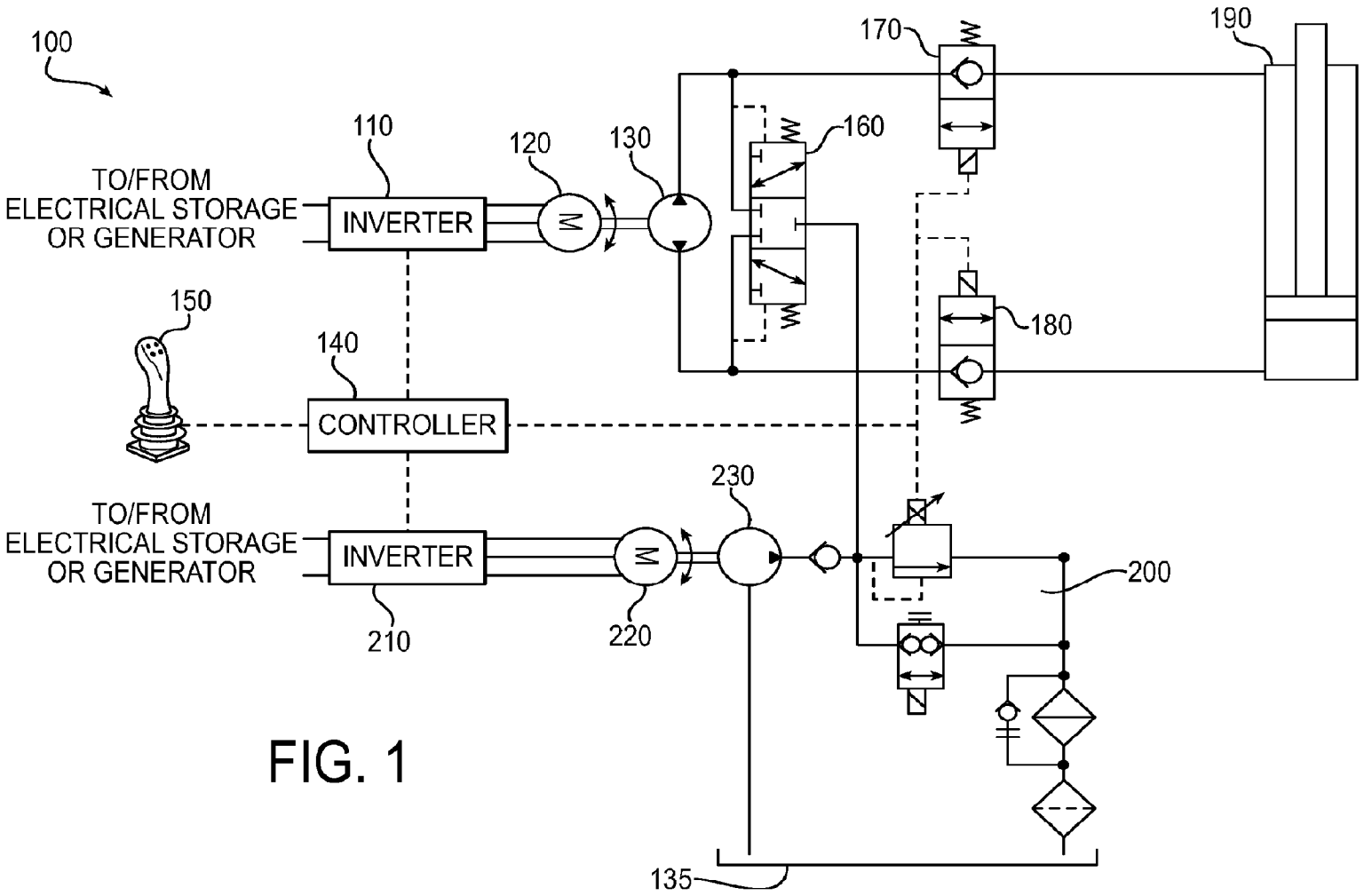
FIG. 1 illustrates an exemplary schematic electro-hydrostatic actuator system.

Referring in detail to FIG. 1, an exemplary embodiment of an electro-hydrostatic actuator system 100 is shown. The system includes at least one actuator 190 to be mechanically connected to a work machine and hydraulically connected to the system 100.

An inverter 110 may be connected to an electrical energy source or energy unit such as an electrical storage (e.g., one or more batteries) or a generator and controls an electric machine 120 (e.g., an electric motor) in bi-directional speed or torque control mode. The electric machine 120 may be mechanically coupled to and drive a hydraulic pump 130, which may be any appropriate type, but is generally a fixed displacement, variable speed pump. The inverter may also store energy generated by the electrical machine in the storage when the pump is back-driven by hydraulic fluid, for example, during a down motion of the actuator when under an external load.

The operator of the system may command a desired actuator speed or force through an input device such as a joystick 150 connected to a controller 140. In other embodiments, a separate command controller may generate the command signal that is passed to the controller 140, for example if the work machine is being remotely or autonomously controlled.

The controller 140 issues commands to the inverter 110 which in conjunction with the motor 120 and pump 130 allows generation of bi-directional flow and pressure via the hydraulic pump 130. The flow is then directed through load holding valves 170, 180 to the actuator 190 yielding the desired actuator motion.

FIG. 1 shows the load holding valves 170, 180 as being ON/OFF type valves, however either or both of these valves could also be flow-control valves, orifice valves or any other proportionally adjustable valve. Exemplary valves are poppet valves so as to prevent leakage through the valves when the valves are closed.

Because most mobile machinery uses un-balanced actuators with a large and small volume chamber, a flow management system 200, for example as presented in U.S. Patent Application Publication No. 2011/0030364 A1 (incorporated herein by reference), controlled by a second inverter 210 and second electric machine 220 and second hydraulic pump 230, provides whatever input flow required by the actuator pump 130 via the shuttle valve 160.

During an actuator extend motion to lift a load, the actuator pump 130 provides flow into the large volume of the actuator 190 (the piston side) and the flow management system 200 is connected to the actuator pump inlet via the shuttle valve 160, ensuring that the flow difference of large volume minus small volume (the rod side) is provided to the actuator pump 130.

During an actuator retraction motion to lower a load, the actuator pump 130 consumes flow from the large volume of the actuator 190 and the flow management system 200 is connected to the actuator pump outlet via the shuttle valve 160, diverting excess flow of large volume minus small volume back to the flow management system 200 and ultimately to the hydraulic reservoir 135.

Although the actuator depicted is a cylinder, it is contemplated that other actuators are possible. Further, the orientation of the cylinder may be reversed from that which is shown.

In general, when the operator does not command an actuator motion, both load holding valves 170, 180 may be closed to remove the hydraulic load from the pump, reduce consumption of electrical energy and prevent the load from dropping in case the pump drive source is turned off. This may cause the pressure between the load holding valves and pump to decay over time, largely due to leakage in the pump. The pressure between the load holding valves and actuator, however, remains at a level to support the external load without actuator motion.

Figure 2:
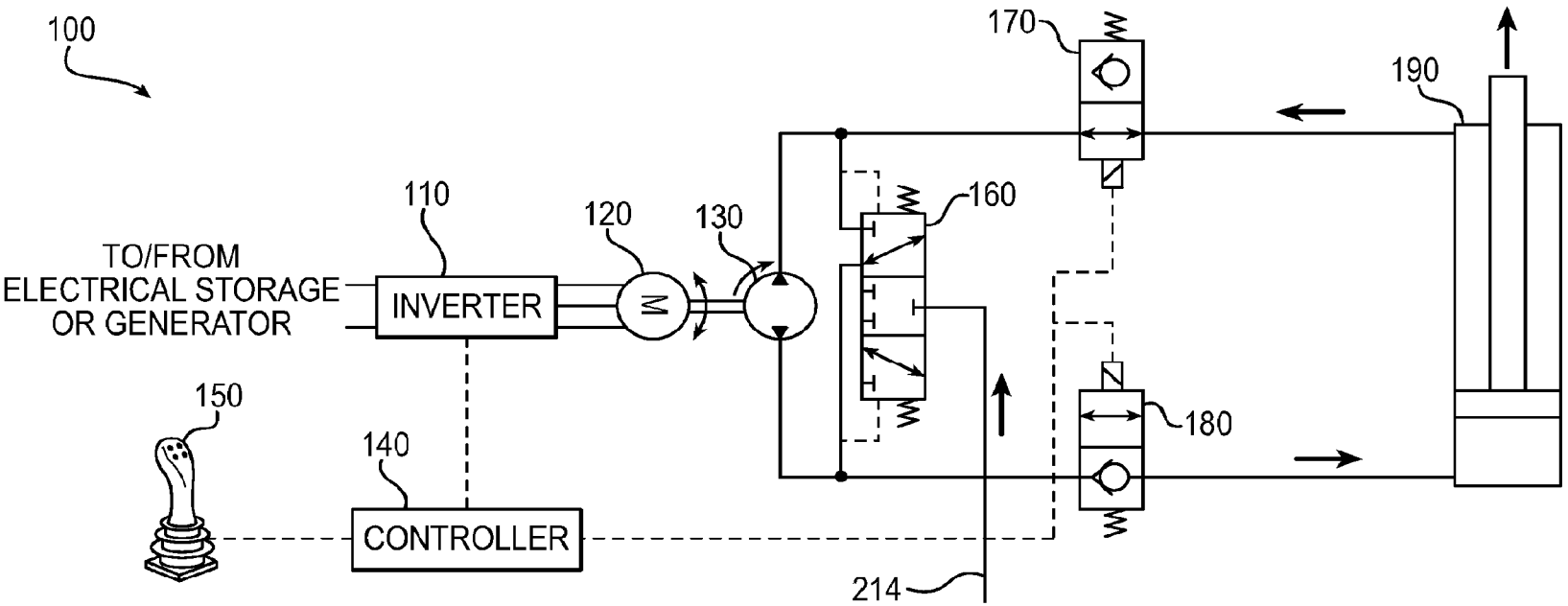
FIG. 2 illustrates an exemplary, simplified schematic embodiment of a system showing an actuator extension motion, direction of fluid flow indicated by arrows and load holding valve states to enable this motion.

Referring now in detail to FIG. 2, an exemplary embodiment of an electro-hydrostatic actuator system 100 is shown. The system is the same as that shown in FIG. 1, except that the flow management system 200 is hidden to focus on operation of the remaining system. Hydraulic connection 214 indicates the to/from connection to the flow management system 200 shown in FIG. 1.

Referring back to FIG. 2, the hydraulic actuator 190 is mechanically connected to a work machine and the arrow above the actuator is used to indicate the direction of motion: extension of the actuator. The remaining arrows indicate hydraulic fluid flow direction in the system.

In order to enable an actuator extension motion, load holding valve 170 needs to be commanded open as indicated to allow fluid flow from the small volume of the actuator back to the electrically driven pump 130. Load holding valve 180 does not have to be commanded open in this case, since the type of valve used in this example includes a check valve that will pass flow freely from pump 130 into the large volume of the actuator.

Figure 3:
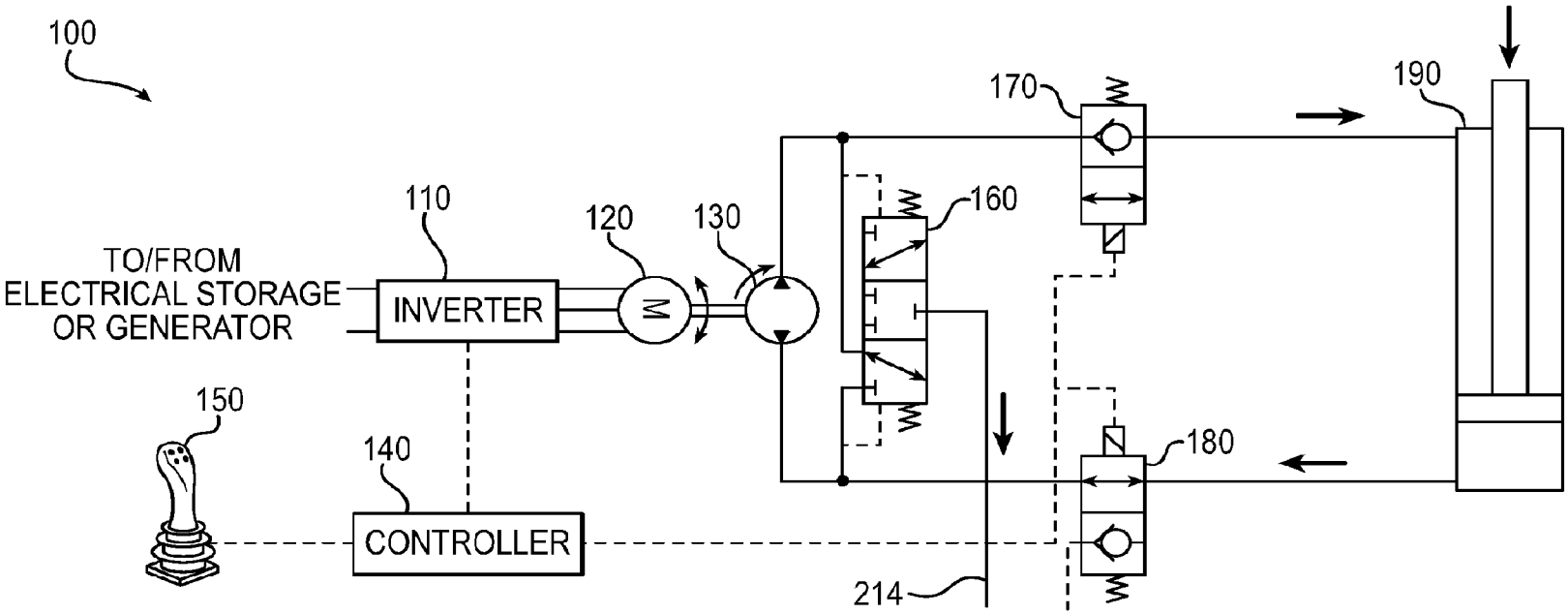
FIG. 3 illustrates an exemplary, simplified embodiment of a system showing an actuator retraction motion, direction of fluid flow indicated by arrows and load holding valve states to enable this motion.

Referring now in detail to FIG. 3, an exemplary embodiment of an electro-hydrostatic actuator system is shown. The system is the same as that shown in FIG. 1, except that the flow management system 200 is hidden to focus on operation of the remaining system. Hydraulic connection 214 indicates the to/from connection to the flow management system shown as item 200 in FIG. 1. The arrow above the actuator is used to indicate the direction of motion: retraction of the actuator.

In order to enable an actuator retraction motion, load holding valve 180 needs to be commanded open as indicated to allow fluid flow from the large volume of the actuator back to the electrically driven pump 130. Load holding valve 170 does not have to be commanded open in this case, since the type of valve used in this example includes a check valve that will pass flow freely from pump 130 into the large volume of the actuator.

Figure 4:
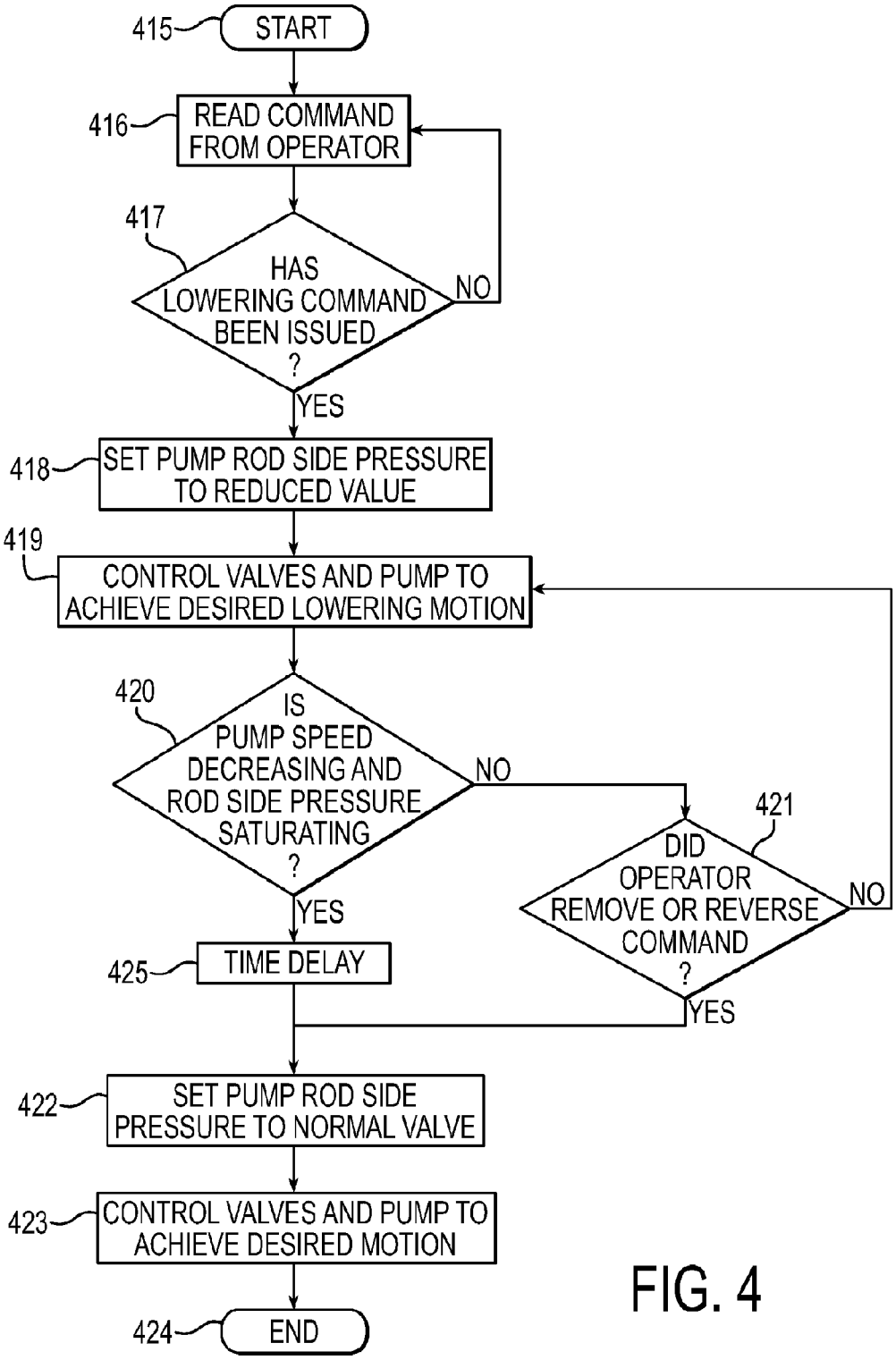
FIG. 4 illustrates an example signal control flow diagram depicting an exemplary method for lowering an actuator in an exemplary hydraulic system.

Referring now in detail to FIG. 4, a signal control flow diagram is shown to support the detailed illustration of process flow of the invention. Although discussed in reference to an "operator" or "user", it is contemplated that such method may be employed by an on-site human operator, a remote human operator, or in an autonomous or semi-autonomous mode in which an "operator command" or "user command" is generated by the autonomous or semi-autonomous control program. Further, it should be understood that references to the stopping of a "lowering command" or the like encompass any command indicating a stop of the motion of an actuator being acted upon by an external force in an unbalanced manner (i.e., resulting in a net external force on the actuator), and a "lowering command" or the like encompasses any command indicating motion of the actuator in the direction the actuator is acted upon by an external force in an unbalanced manner (i.e., resulting in a net external force on the actuator).

The logic starts at the initial Start block 415.

Continuous and/or intermittent monitoring of the operator input device occurs in block 416.

As long as no input signal is given, the decision block 417 defaults the signal flow back to monitoring the operator input device.

If the operator does issue a lowering command, the system in 418 may set the first side of the hydraulic circuit (e.g., pump rod side, although the piston side may alternatively or additionally controlled in a similar manner) pressure to a reduced value.

The control valves and pumps may be activated to achieve a desired lowering motion at 419.

Following this, the method may continuously or periodically monitor a condition indicative of the pressure exceeding the limit, such as, for example, the pump speed for a decreasing speed condition and/or the rod side pressure for a saturating condition at block 420. In other words, block 420 may look to see if the command is being executed as requested. If not, this condition may indicate that the system needs a higher pressure limit to implement the request command.

A way of monitoring the first-side pressure is to monitor motor torque. If the torque setting is a reduced torque setting and the limit is quickly reached, this may be an indication that the limit needs to be raised. Another alternative is to measure pressure directly via an optional pressure sensor in the hydraulic circuit.

Another means of limiting the first-side pressure may be to control a pressure relief valve on the first side of the hydraulic circuit and set the pressure limit at which the valve opens at a relatively low pressure. Once the limit is reached, the valve would open and dump pressure to tank in order to control pressure on this side of the system. The limit could then be increased by the controller. However, usage of this means of regulating pressure in the hydraulic circuit would generally be considered less efficient than regulating pump pressure vie a torque/current limitation.

In any case, if the prescribed criteria/criterion is/are not met, the system checks for a removal or reversal of the operator command at block 421.

If no command removal or reversal is indicated, then the method returns to block 419.

If the prescribed criteria/criterion of step 420 is/are met, or if not met but a command removal or reversal is indicated, then the first side pressure is set to a normal value at 422. In this case, "normal" means the operating pressure that would be used to control the function given the command absent the desire the mimic a conventional load sense "hesitation" when a function is impeded by a load. This value may simply be set so as to prevent damage to the system, for example.

Optionally, setting the value to "normal" at block 422 may include ramping up the pressure setting in a gradual manner (either linearly or non-linearly) in order to effectuate the desired delay to mimic a load-sense system.

Optional block 425 may add a prescribed delay in addition to that inherent in the system in order to achieve the desired hesitation when a function is impeded by a load during movement. This delay may be a fixed value, or may depend upon one or more other factors such as, for example, pump type, velocity of actuator, pump wear, commanded speed, personal preference of the operator, etc.

The pump and/or control valves may then be commanded to implement and achieve the desired motion at block 423 and the process ends at block 424.

While for purposes of simplicity of explanation, the illustrated method is shown and described above as a series of blocks, it is to be appreciated that the method is not limited by the order of the blocks, as some blocks can occur in different orders or concurrently with other blocks from that shown or described. Moreover, less than all the illustrated blocks may be required to implement an example methodology. Furthermore, additional or alternative methodologies can employ additional, not illustrated blocks.

In the flow diagram, blocks denote "processing blocks" that may be implemented with logic. The processing blocks may represent a method step or an apparatus element for performing the method step. A flow diagram does not depict syntax for any particular programming language, methodology, or style (e.g., procedural, object-oriented). Rather, a flow diagram illustrates functional information one skilled in the art may employ to develop logic to perform the illustrated processing. It will be appreciated that in some examples, program elements like temporary variables, routine loops, and so on, are not shown. It will be further appreciated that electronic and software applications may involve dynamic and flexible processes so that the illustrated blocks can be performed in other sequences that are different from those shown or that blocks may be combined or separated into multiple components. It will be appreciated that the processes may be implemented using various programming approaches like machine language, procedural, object oriented or artificial intelligence techniques.

In one example, methodologies are implemented as processor executable instructions or operations provided on a computer-readable medium. Thus, in one example, a computer-readable medium may store processor executable instructions operable to perform a method.

While FIG. 4 illustrates various actions occurring in serial, it is to be appreciated that various actions illustrated in FIG. 4 could occur substantially in parallel.

"Logic," as used herein, includes but is not limited to hardware, firmware, software or combinations of each to perform a function(s) or an action(s), or to cause a function or action from another logic, method, or system. For example, based on a desired application or needs, logic may include a software controlled microprocessor, discrete logic like an application specific integrated circuit (ASIC), a programmed logic device, a memory device containing instructions, or the like. Logic may include one or more gates, combinations of gates, or other circuit components. Logic may also be fully embodied as software. Where multiple logical logics are described, it may be possible to incorporate the multiple logical logics into one physical logic. Similarly, where a single logical logic is described, it may be possible to distribute that single logical logic between multiple physical logics.

"Software," as used herein, includes but is not limited to, one or more computer or processor instructions that can be read, interpreted, compiled, or executed and that cause a computer, processor, or other electronic device to perform functions, actions or behave in a desired manner. The instructions may be embodied in various forms like routines, algorithms, modules, methods, threads, or programs including separate applications or code from dynamically or statically linked libraries. Software may also be implemented in a variety of executable or loadable forms including, but not limited to, a stand-alone program, a function call (local or remote), a servelet, an applet, instructions stored in a memory, part of an operating system or other types of executable instructions. It will be appreciated by one of ordinary skill in the art that the form of software may depend, for example, on requirements of a desired application, the environment in which it runs, or the desires of a designer/programmer or the like. It will also be appreciated that computer-readable or executable instructions can be located in one logic or distributed between two or more communicating, co-operating, or parallel processing logics and thus can be loaded or executed in serial, parallel, massively parallel and other manners.

Suitable software for implementing the various components of the example systems and methods described herein may be produced using programming languages and tools like Java, Java Script, Java.NET, ASP.NET, VB.NET, Cocoa, Pascal, C#, C++, C, CGI, Perl, SQL, APIs, SDKs, assembly, firmware, microcode, or other languages and tools. Software, whether an entire system or a component of a system, may be embodied as an article of manufacture and maintained or provided as part of a computer-readable medium.

Algorithmic descriptions and representations used herein are the means used by those skilled in the art to convey the substance of their work to others. An algorithm or method is here, and generally, conceived to be a sequence of operations that produce a result. The operations may include physical manipulations of physical quantities. Usually, though not necessarily, the physical quantities take the form of electrical or magnetic signals capable of being stored, transferred, combined, compared, and otherwise manipulated in a logic and the like.

It has proven convenient at times, principally for reasons of common usage, to refer to these signals as bits, values, elements, symbols, characters, terms, numbers, or the like. It should be borne in mind, however, that these and similar terms are to be associated with the appropriate physical quantities and are merely convenient labels applied to these quantities. Unless specifically stated otherwise, it is appreciated that throughout the description, terms like processing, computing, calculating, determining, displaying, or the like, refer to actions and processes of a computer system, logic, processor, or similar electronic device that manipulates and transforms data represented as physical (electronic) quantities.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electro-hydrostatic system comprising:

a controller connected to an operator interface;

a pump operable in a first direction for supplying pressurized fluid;

an electric machine operated by the controller and connected to an electrical source through an inverter to drive the pump; and a hydraulic circuit having a first side fluidly connecting a first side of the pump to a first port for connection to a consumer, and a second side fluidly connecting the second side of the pump to a second port for connection to the consumer;

wherein the controller is configured:

to receive a user input for controlling the consumer and to supply hydraulic fluid in accordance therewith, to set the first side of the hydraulic circuit pressure limit to a reduced value pressure limit in response to the user input;

to watch for a parameter, the parameter being indicative of pressure in the first side of the hydraulic circuit exceeding the reduced value pressure limit, and in response to the parameter indicative of the pressure exceeding the reduced value pressure limit, to restrict pressure in the first side of the hydraulic circuit until the pressure limit is increased, thereby delaying consumer motion unless a command to stop consumer motion is given and mimicking responsiveness in a conventional load-sense system, and to determine to increase the pressure limit based on receipt of the parameter indicative of the pressure exceeding the reduced value pressure limit.

2. The electro-hydrostatic system of claim 1, further comprising valving fluidly connected between the pump and the ports, the valving controlled by the controller and operative to regulate the pressurized fluid between the pump and the consumer.

3. The electro-hydrostatic system of claim 1, wherein the user command is a command for lowering an actuator.

4. The electro-hydrostatic system of claim 1, wherein the consumer is a hydraulic cylinder and the first side of the hydraulic circuit is fluidly connected to a rod-side of the hydraulic cylinder.

5. The electro-hydrostatic system of claim 1, wherein the controller is further configured to delay increasing the pressure limit after determining to increase the pressure limit based on receipt of the parameter indicative of the pressure exceeding the reduced value pressure limit.

6. The electro-hydrostatic system of claim 1, wherein the parameter is pump speed.

7. The electro-hydrostatic system of claim 1, wherein the parameter is a movement state of the consumer.

8. The electro-hydrostatic system of claim 1, wherein the parameter is electric machine torque.

9. The electro-hydrostatic system of claim 1, wherein the parameter is pressure in the first side of the hydraulic circuit.

10. The electro-hydrostatic system of claim 1, wherein the controller is further configured to restrict pressure by setting a torque limit of the electric machine.

11. The electro-hydrostatic system of claim 1, wherein the pump is a bi-directional pump operable in a first direction for supplying pressurized fluid through the first valve to the consumer for operating the consumer in one direction, and operable in a second direction opposite the first direction for supplying pressurized fluid through a second valve to the consumer for operating the consumer in a direction opposite the first direction.

12. The electro-hydrostatic system of claim 1, further comprising:

a hydraulic actuator to and from which hydraulic fluid is supplied and returned in opposite directions to operate the actuator in opposite directions.

13. The electro-hydrostatic system of claim 1, further comprising:

a boost system for accepting fluid from or supplying fluid to the hydraulic circuit of the hydraulic system, wherein the boost system includes:

a boost pump for supplying fluid to a fluid make-up/return line that selectively is in fluid communication with the consumer, and a boost electric machine for driving the boost pump, the electric machine connected to a boost electric power source through a boost inverter.

14. The electro-hydrostatic system of claim 1, wherein the valving includes a load-holding valve connected between the pump and the first port, the load-holding valve controlled by the controller and operative in a first position to allow flow to the consumer to operate the consumer against a load and operative in a second position to block load-induced return flow from the consumer to the pump.

15. A method of preventing over-actuation in an electro-hydrostatic system, the method comprising the steps of:

receiving a requested consumer command;

setting a maximum pressure limit of a first side of a hydraulic circuit fluidly connected to the consumer to a first value in response to the requested consumer command;

controlling a pump and valving in the hydraulic circuit to achieve the requested consumer command;

driving the pump via an electric machine connected to an electrical source through an inverter;

monitoring a first system condition, the first system condition being indicative of pressure in the first side of the hydraulic circuit exceeding the first value;

restricting pressure in the first side of the hydraulic circuit until the pressure limit is increased, evaluating the monitored system condition with a prescribed criteria in response to the requested consumer command; and determining whether or not to increase the maximum pressure limit based on the evaluation, thereby delaying consumer motion unless a command to stop consumer motion is given and mimicking responsiveness in a conventional load-sense system.

16. The method of claim 15, wherein the consumer command is a command for lowering an actuator.

17. The method of claim 15, wherein the consumer is a hydraulic cylinder and the first side of the hydraulic circuit is fluidly connected to a rod-side of the hydraulic cylinder.

18. The method of claim 15, wherein the controller is further configured to delay increasing the maximum pressure limit after determining to increase the maximum pressure limit based on the evaluation.

19. The method of claim 15, wherein the first system condition is pump speed.

20. The method of claim 15, wherein the first system condition is a movement state of the consumer.

21. The method of claim 15, further comprising controlling and driving the pump via an electric machine, wherein the first system condition is electric machine torque.

22. The method of claim 15, wherein the first system condition is pressure in the first side of the hydraulic circuit.

23. The method of claim 15, further comprising controlling and driving the pump via an electric machine, wherein setting the maximum pressure limit includes setting a torque limit of the electric machine.

24. The method of claim 15, wherein the pump is a bi-directional pump operable in a first direction for supplying pressurized fluid through the first valve to the hydraulic actuator for operating the actuator in one direction, and operable in a second direction opposite the first direction for supplying pressurized fluid through a second valve to the hydraulic actuator for operating the actuator in a direction opposite the first direction.

25. The method of claim 15, wherein the consumer is a hydraulic actuator to and from which hydraulic fluid is supplied and returned in opposite directions to operate the actuator in opposite directions.

26. The method of claim 15, further comprising:

accepting fluid from or supplying fluid to a hydraulic circuit of the hydraulic system via a boost system, wherein the boost system includes:

a boost pump for supplying fluid to a fluid make-up/return line that selectively is in fluid communication with the hydraulic actuator, and a boost electric machine for driving the boost pump, the electric machine connected to a boost electric power source through a boost inverter.

27. The method of claim 15, wherein the valving includes a load-holding valve connected between the pump and the first port, the load-holding valve controlled by the controller and operative in a first position to allow flow to the actuator to operate the actuator against a load and operative in a second position to block load-induced return flow from the actuator to the pump.

28. The method of claim 15, further comprising:

operating the pump in one direction for supplying pressurized fluid through the valve to the hydraulic actuator for operating the actuator in a first direction, and operating the pump in a second direction opposite the first direction for supplying pressurized fluid through a second valve to the hydraulic actuator for operating the actuator in a direction opposite the first direction.

* * * * *